US011992107B2

(12) United States Patent
Zhou

(10) Patent No.: US 11,992,107 B2
(45) Date of Patent: May 28, 2024

(54) PACKAGING DEVICE AND REFILL DEVICE

(71) Applicant: PPK (SHANGHAI) PACKAGING CO., LTD, Shanghai (CN)

(72) Inventor: Helin Zhou, Shanghai (CN)

(73) Assignee: PPK (SHANGHAI) PACKAGING CO., LTD, Shanghai (CN)

( * ) Notice: Subject to any disclaimer, the term of this patent is extended or adjusted under 35 U.S.C. 154(b) by 6 days.

(21) Appl. No.: 17/582,694

(22) Filed: Jan. 24, 2022

(65) Prior Publication Data

US 2022/0160101 A1 May 26, 2022

Related U.S. Application Data

(63) Continuation-in-part of application No. PCT/CN2021/090577, filed on Apr. 28, 2021.

(30) Foreign Application Priority Data

Jul. 17, 2020 (CN) ..... 202010691125.9

(51) Int. Cl.
*A45D 40/04* (2006.01)
*A45D 40/00* (2006.01)
*A45D 40/20* (2006.01)

(52) U.S. Cl.
CPC ..... *A45D 40/04* (2013.01); *A45D 2040/0031* (2013.01); *A45D 2040/204* (2013.01)

(58) Field of Classification Search
CPC ..... A45D 40/00; A45D 40/04; A45D 2040/0031; A45D 2040/0025;
(Continued)

(56) References Cited

U.S. PATENT DOCUMENTS 6,269,982 B1 8/2001 Kreiseder et al.
11,553,778 B2 * 1/2023 Trochel ..... A45D 40/16
(Continued)

FOREIGN PATENT DOCUMENTS

CN 110897304 A 3/2020
CN 111874415 A 11/2020
(Continued)

OTHER PUBLICATIONS

International Search Report and Written Opinion for International Application No. PCT/CN2021/090577, dated Jul. 15, 2021, 7 pages.
(Continued)

*Primary Examiner* — David J Walczak
(74) *Attorney, Agent, or Firm* — NSIP Law

(57) ABSTRACT

A packaging device and a refill device, wherein the packaging device comprises a first case cap, a first case body and a lifting mechanism; the first case body has a first end and a second end, and the first case cap is snap-fitted on the first end of the first case body; the lifting mechanism comprises a base and a lifting platform, wherein the base and the lifting platform are movably connected, the base is arranged at the second end of the first case body, and the lifting platform is arranged in the first case body; and the lifting platform can move close to or away from the base, and the lifting mechanism is detachably connected to the first case body.

14 Claims, 13 Drawing Sheets

(58) Field of Classification Search
CPC ..... A45D 2040/204; A45D 40/20; A45D 2040/0037; A45D 2040/0043; A45D 2040/005; A45D 2040/0056
USPC ..... 401/176–179, 75–79
See application file for complete search history.

(56) References Cited

U.S. PATENT DOCUMENTS

| | | | | |
|---|---|---|---|---|
| 2013/0344016 | A1 | 12/2013 | Reed | |
| 2023/0030527 | A1* | 2/2023 | Shen | A45D 34/00 |

FOREIGN PATENT DOCUMENTS

| | | | |
|---|---|---|---|
| CN | 213036318 | U | 4/2021 |
| CN | 213036319 | U | 4/2021 |
| GB | 2591003 | A | 7/2021 |
| JP | 2005271940 | A | 10/2005 |
| WO | 2010008880 | A1 | 1/2010 |

OTHER PUBLICATIONS

Great Britain Examination Report for GB Application No. 2200540.9, dated Feb. 9, 2022, 3 pages.
Notification of Grant for Patent Serial No. GB2599063, dated Nov. 1, 2022, 2 pages.

* cited by examiner

PACKAGING DEVICE AND REFILL DEVICE

CROSS-REFERENCE TO RELATED APPLICATIONS

This application is a U.S. continuation-in-part application which claims priority from PCT/CN2021/090577, filed Apr. 28, 2021, which claims priority from CN 202010691125 9, filed Jul. 17, 2020, which are both incorporated herein by reference in their entireties.

TECHNICAL FIELD

The present invention relates to the technical field of household chemicals, and more particularly, to a packaging device for household chemicals and a refill device.

BACKGROUND ART

Deodorant cream, lipstick and other pasty or solid cosmetics are easy to carry, can be used anytime and anywhere. When they are wiped on the hands, ears, mouth and other parts of the human body, it gives off fresh and pleasant fragrance, beautifying people's life and image.

In order to carry the pasty or solid cosmetics conveniently, there are usually packaging devices such as case packaging, canned packaging or tube packaging, etc. After the use of the cosmetic paste, the packaging materials are usually discarded completely and cannot be reused. When new pasty cosmetics are taken for use, it needs new packaging materials, resulting in extreme waste. In addition, the packaging materials are usually not degradable; and a large amount of discarded packaging materials seriously pollute the environment. Therefore, there is a need to provide a packaging device and a refill device of which the packaging device can be reused after the pasty or solid household chemicals are used up.

SUMMARY OF THE INVENTION

The technical problem to be solved by the present invention is to provide a packaging device and a refill device. After the pasty or solid household chemicals have been used up, the refill device can be placed and used continuously, avoiding waste of packaging materials.

In order to solve the above-mentioned technical problem, the present invention provides a packaging device comprising a first case cap, a first case body and a lifting mechanism; the first case body has a first end and a second end, and the first case cap is snap-fitted on the first end of the first case body; the lifting mechanism comprises a base and a lifting platform, wherein the base and the lifting platform are movably connected, the base is arranged at the second end of the first case body, and the lifting platform is arranged in the first case body; the lifting platform comprises a bottom plate, a lifting platform main body and a boss; the bottom end of the lifting platform main body is connected to the bottom plate, the top surface of the lifting platform main body is provided with the boss, and the bottom plate is provided with a first through hole; a threaded rod is fixedly arranged on the base; the first through hole is engaged with teeth of the threaded rod; the threaded rod passes through the first through hole and extends into the lifting platform main body; and the bottom plate can move along the threaded rod when the threaded rod rotates, so that the lifting platform can move close to or away from the base.

Preferably, 2-16 barbs are provided on the boss, a plurality of the barbs being symmetrically distributed on the boss.

Preferably, the lifting mechanism comprises a fixed sleeve having a bottom and an open end, the fixed sleeve being sleeved outside the lifting platform and the lifting platform protruding from the open end of the fixed sleeve; the bottom of the fixed sleeve is provided with a second through hole; the base is provided with a rotating table passing through the second through hole and being inversely fastened to the bottom of the fixed sleeve; the bottom of the threaded rod is fixed to the rotating table; and the base is rotatable relative to the fixed sleeve by the rotating table.

Preferably, the fixed sleeve comprises a fixed sleeve main body and buttons provided on both sides of the fixed sleeve main body; a clamping hole is provided on the first case body at a position corresponding to the button; and the button is clamped in the clamping hole to detachably connect the first case body and the lifting mechanism.

Preferably, the button is made of an elastic material, or a slotting is formed between the button and the fixed sleeve main body; both sides of the lifting platform are provided with avoidance holes matched with the buttons; and when the button is located in the avoidance hole, the lifting mechanism can be detached from inside of the first case body.

Preferably, the lifting platform main body is further provided with a raised strip arranged between the avoidance hole and the bottom of the lifting platform.

Preferably, the top of the threaded rod is provided with at least one tab that can be clamped to the bottom plate at the first through hole to prevent the bottom plate from disengaging the threaded rod.

Preferably, the tabs have the number of 2 and are arranged symmetrically at the top of the threaded rod; the tabs are integral with the threaded rod; and the threaded rod, the rotating table and the base are integrally formed.

Preferably, the first case body comprises an inner case and an outer case, the outer case being closely adhered to the outside of the inner case; the clamping holes are provided on both sides of the outer case; and an avoidance slot extending towards the second end is provided on the side of the inner case at a position corresponding to the position of the clamping hole.

Preferably, a side wall of the first case cap is provided with a cap sleeve, and an outer side of the base is provided with a base sleeve; and the inner case, the case cap or/and the lifting mechanism are all made of plastic, and the outer case, the case cap sleeve or/and the base sleeve are all made of aluminum alloy.

In order to solve the above technical problem, the present invention also provides a refill device, which is used in combination with the above packaging device, wherein the refill device comprises a second case body and a case bottom; the second case body has a third end and a fourth end; the case bottom is detachably clamped at the fourth end of the second case body, and movable along an inner cavity of the second case body towards the third end of the second case body; and the second case body and the case bottom constitutes a case body for containing pasty or solid household chemicals.

Preferably, the fourth end of the second case body is formed with a first flange extending inwards, and the first flange locates the case bottom inside the second case body; or, the case bottom and the second case body are integrally formed; the case bottom is provided with a first cutting line for enclosing a portion to form a bottom bracket; and the bottom bracket can be separated from the second case body along the first cutting line under the action of an external force.

Preferably, it further comprises a second case cap that snaps onto and is detachably from the second case body; the second case cap is an embedded case cap or an outer cover-type case cap; or an open end of the case body is covered with a protective film closing the open end; the open end of the case body extends to the outside of the case body to form a flanging; the protective film is coated on the surface of the flanging; the case body is separated from the flanging by a second cutting line; and the flanging can be separated from the case body along the second cutting line under the action of an external force.

Preferably, the bottom of the case bottom is recessed in the direction of the third end to form a groove, with the depth of the groove being 6-8 mm; at least one third through hole is provided on the bottom of the case bottom; and the third through hole is used for pouring liquid household chemicals into the refill device.

Preferably, the second case body, the second case cap, and the case bottom are made of made of degradable materials.

The present invention has the following advantageous effects compared to the prior art. The present invention provides a packaging device and a refill device, wherein a lifting mechanism and a first case body are detachably connected in the packaging device, and the packaging device and the refill device are used cooperatively; after the lifting mechanism is disassembled, an old refill device can be discarded, and a new refill filled with pasty or solid household chemicals can be loaded into the first case body, so that the packaging device can be reused; the base of the lifting mechanism is rotated to move the lifting platform against the case bottom of the refill device so as to achieve the ejection and retraction of the pasty or solid household chemicals, facilitating the use of the pasty or solid household chemicals; at the same time, the refill device is a degradable material, which can be recycled and more environmentally friendly. Thus, the present invention provides a packaging device that can be reused, resulting in substantial savings in packaging materials, while avoiding significant environmental contamination due to extensive disposal of the packaging materials.

1, first case cap; 2, first case body; 3, refill device; 4, lifting mechanism; 11, case cap sleeve; 12, side wall; 21, inner case; 22, outer case; 23, first end; 24, second end; 31, second case body; 32, case bottom; 33, second case cap; 34, first cutting line; 35, bottom bracket; 36, protective film; 37, second cutting line; 38, flanging; 41, lifting platform; 42, bottom plate; 43, fixed sleeve; 44, threaded rod; 45, base; 46, base sleeve; 47, rotating table; 211, avoidance slot; 212, second flange; 221, clamping hole; 311, third end; 312, fourth end; 321, groove; 322, third through hole; 361, ripped portion; 411, avoidance hole; 412, boss; 413, lifting platform main body; 414, raised strip; 415, barb; 421, first through hole; 431, button; 432, bottom; 433, open end; 434, fixed sleeve main body; 435, slotting; 441, limit piece; and 471, inverted structure.

DETAILED DESCRIPTION OF THE INVENTION

The present invention is further described below in combination with the attached drawings and embodiments.

Figure 1:
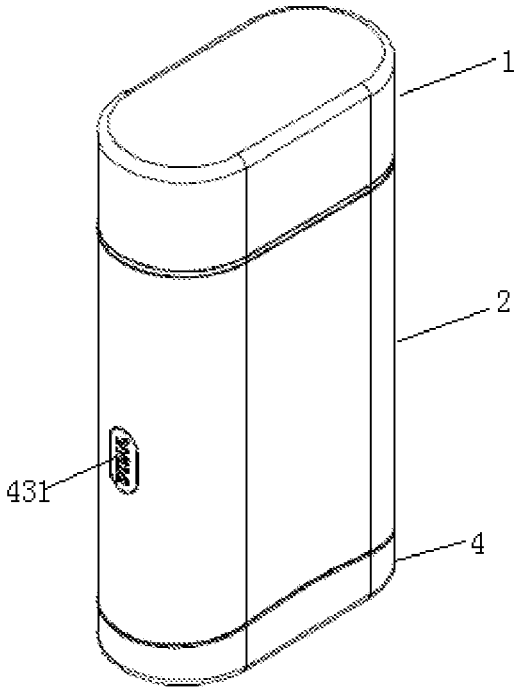
FIG. 1 is a schematic view showing an overall structure of a packaging device according to an embodiment of the present invention.
Figure 2:
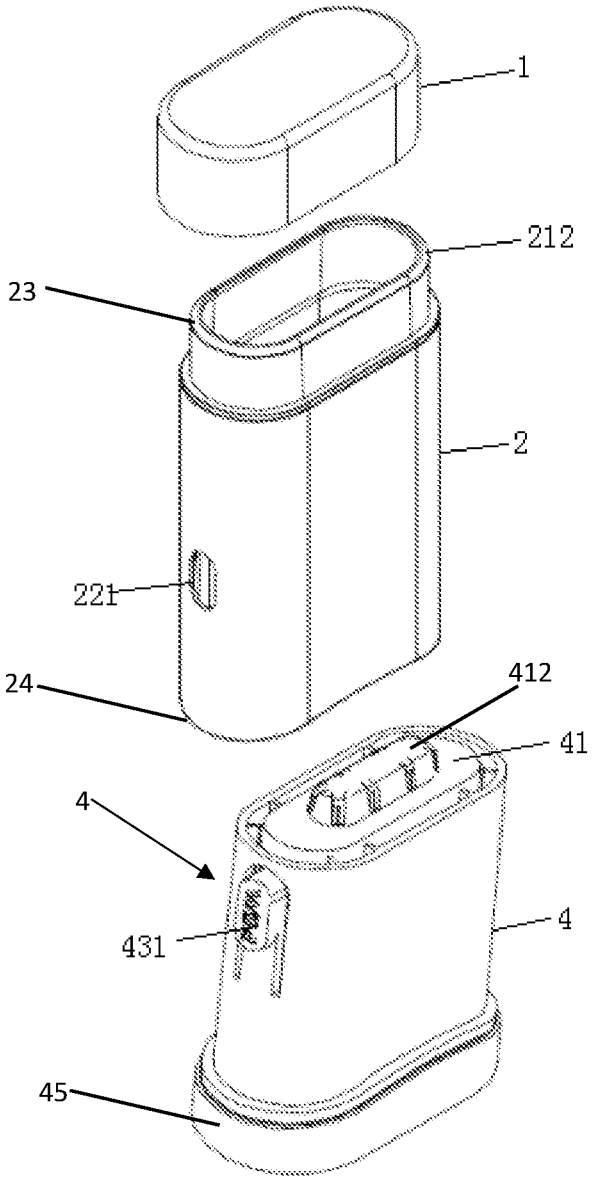
FIG. 2 is a schematic view showing an exploded structure of a packaging device according to an embodiment of the present invention.

FIG. 1 is a schematic view showing an overall structure of a packaging device according to an embodiment of the present invention; and FIG. 2 is a schematic view showing an exploded structure of a packaging device according to an embodiment of the present invention.

Referring to FIGS. 1 and 2, a packaging device provided by an embodiment of the present invention includes a first case cap 1, a first case body 2, and a lifting mechanism 4; the first case body 2 has a first end 23 and a second end 24, and the first case cap 1 is snap-fitted on the first end 23 of the first case body 2; the lifting mechanism 4 includes a base 45 and a lifting platform 41, wherein the base 45 and the lifting platform 41 are movably connected, the base 45 is arranged at the second end 24 of the first case body 2, and the lifting platform 41 is arranged in the first case body 2; and the lifting platform 41 can move close to or away from the base 45, and the lifting mechanism 4 is detachably connected to the first case body 2.

Figure 3:
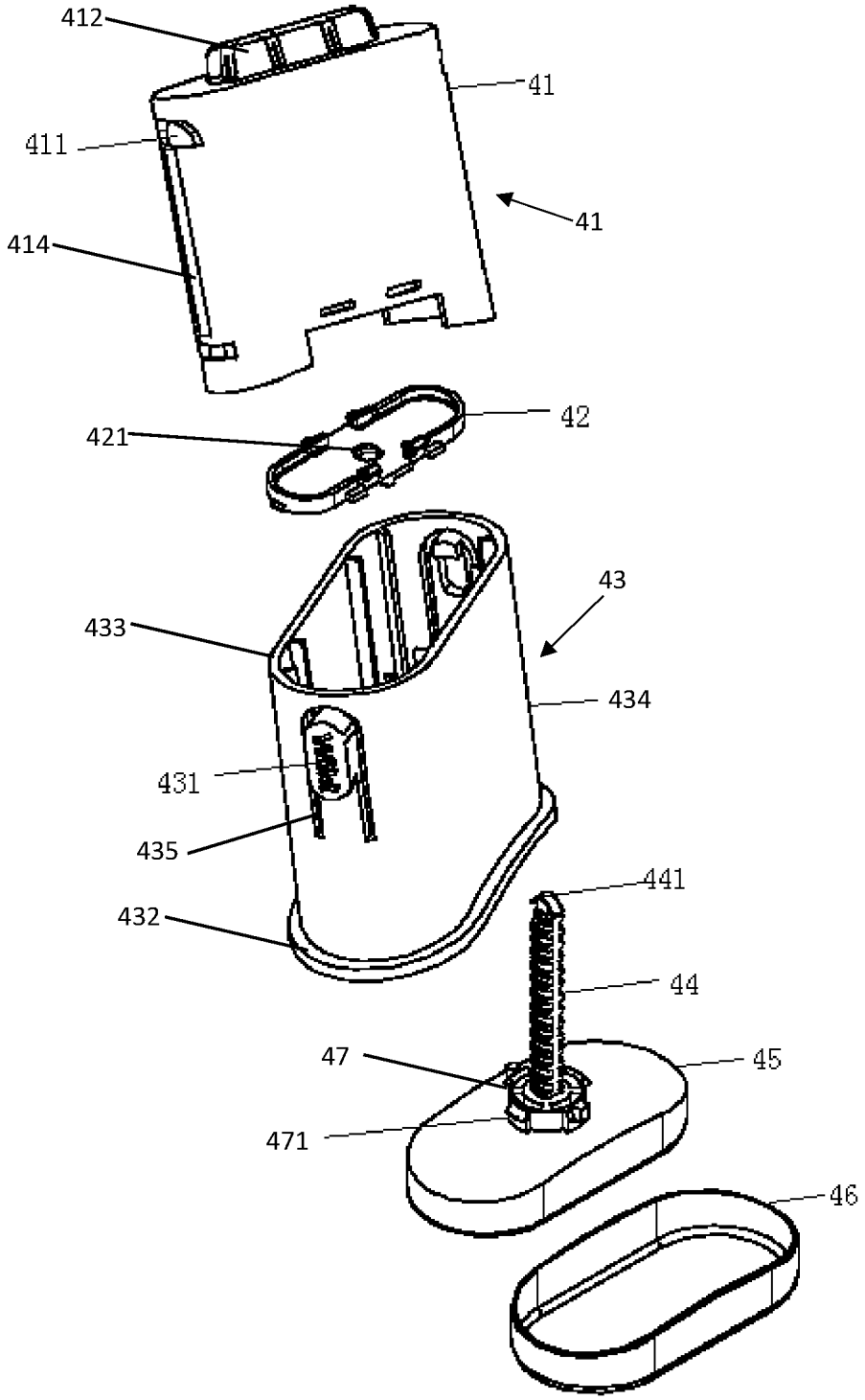
FIG. 3 is a schematic view showing an exploded structure of a lifting mechanism according to an embodiment of the present invention.
Figure 4:
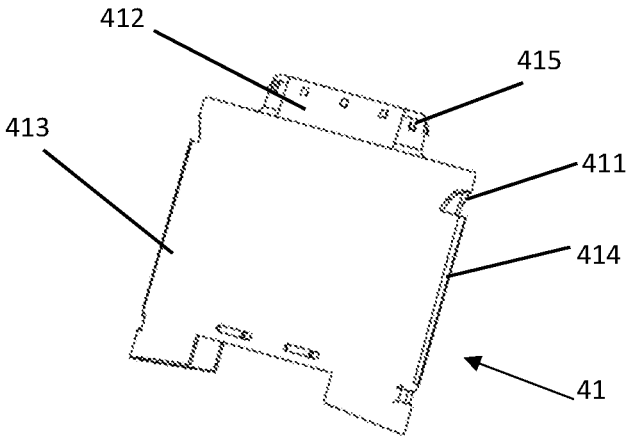
FIG. 4 is a schematic view showing a structure of a lifting platform according to another embodiment of the present invention.

With reference to FIG. 3, the lifting mechanism 4 is a rotary lifting mechanism including a bottom plate 42, a lifting platform main body 413 and a boss 412; and the bottom end of the lifting platform main body 413 is connected to the bottom plate 42, and the top surface of the lifting platform main body 413 is provided with the boss 412. Preferably, the lifting platform main body 413 and the bottom plate 42 are detachably connected in a plug-in or clamp-in manner. In particular, a matched protrusion and a clamping slot can be provided on the lifting platform main body 413 and the bottom plate 42 for clamp-in connection; and a first through hole 421 is provided on the bottom plate 42, a threaded rod 44 is fixedly provided on the base 45, and the first through hole 421 is matched with the threaded rod 44. Specifically, a gap is formed between the threaded rod 44 and the first through hole 421, and the teeth are engaged. The threaded rod 44 passes through the first through hole 421 and extends into the lifting platform body 41. When the base 45 rotates, the threaded rod 44 is rotated to move the bottom plate 42 along the threaded rod 44, thereby moving the lifting platform 41 close to or away from the base 45. In use, the moving position of the lifting platform 41 is controlled by rotating the base 45 clockwise or counterclockwise. Further, at least one limit piece 441 is provided at the top of the threaded rod 44, and the limit piece 441 is clamped on the bottom plate 42 at the first through hole 421 to prevent the bottom plate 42 from being separated from the threaded rod 44. In a specific embodiment, the limit piece 441 has the number of two, symmetrically arranged at the top of the threaded rod 44, like an umbrella. Preferably, the limit piece 441 is integrally formed with the threaded rod 44. Referring to FIG. 4, in another embodiment, at least one barb 415 is also provided on a boss 412. The number of the barbs 415 is preferably 2-16, and a plurality of the barbs 415 are spaced apart in the circumferential direction of the boss 412. More preferably, the plurality of barbs 415 are symmetrically distributed on the boss 412. When the boss 412 abuts against the case bottom 32 of the refill device 3, the barb 415 can increase the friction force between the boss 412 and the groove 321, prevent the case bottom 32 from falling down during the lifting of the lifting platform 41, and allow the case bottom 32 to move smoothly.

Figure 5:
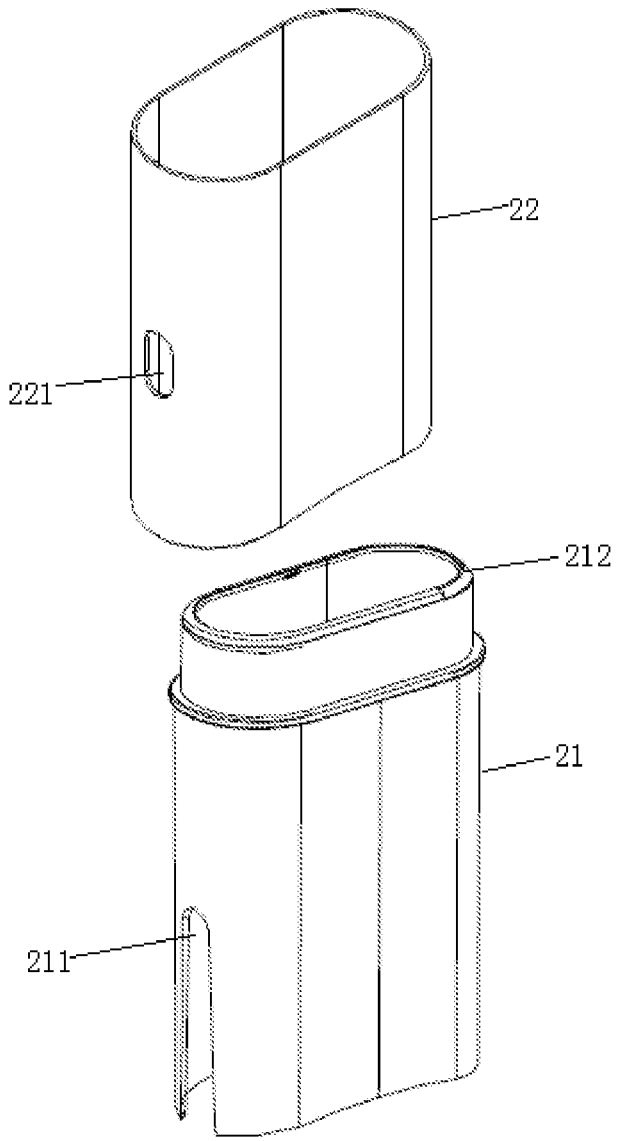
FIG. 5 is a schematic view showing an exploded structure of a first case body of a packaging device according to an embodiment of the present invention.

Further, referring to FIGS. 2 and 3, the lifting mechanism 4 further includes a fixed sleeve 43 having a bottom 432 and an open end 433, the base 45 is provided with a rotating table 47, and the bottom of the threaded rod 44 is fixed to the rotating table 47. Preferably, the base 45, the rotating table 47 and the threaded rod 44 are integrally formed. The bottom 432 of the fixed sleeve 43 has a second through hole; the rotating table 47 is provided with an inverted structure 471; the rotating table 47 passes through the second through hole and is inversely fastened to the bottom 432 of the fixed sleeve 43; the base 45 can rotate relative to the fixed sleeve 43 via the rotating table 47; and the fixed sleeve 43 is sleeved around the lifting platform 41 and the lifting platform 41 protrudes from the open end 433 of the fixed sleeve 43. Thus, when the base 45 is rotated, the rotating table 47 and the threaded rod 44 are rotated. Furthermore, the fixed sleeve 43 comprises a fixed sleeve main body 434 and a button 431 arranged on both sides of the fixed sleeve main body 434. The button 431 is preferably a protrusion. Referring to FIG. 5, a clamping hole 221 is arranged on the first case body 2 at a position corresponding to the button 431; and the button 431 is clamped in the clamping hole 221 to enable the first case body 2 and the lifting mechanism 4 to be detachably connected. Further, the first case body 2 includes an inner case 21 and an outer case 22, wherein the outer case 22 is closely adhered to the outside of the inner case 21; the clamping holes 221 are provided on both sides of the outer case 22; and an avoidance slot 211 extending towards the second end 24 is provided on the side of the inner case 21 at a position corresponding to the clamping hole 221. In an embodiment, the button 431 is made of an elastic material. When an external force is applied to the button 431, the button 431 completely enters the first case body 2, and slides out of the first case body 2 along the avoidance slot 211 so as to separate the lifting mechanism 4 from the first case body 2. When the button 431 slides along the avoidance slot 211 to the clamping hole 221 during installation, the button 431 is automatically restored to its original position due to its elasticity, and is again clamped in the clamping hole 221. In another embodiment, a slotting 435 is formed between the button 431 and the fixed sleeve body 434. When an external force is used, the button 431 can generate a movable stroke so as to completely enter the first case body 2. Meanwhile, both sides of the lifting platform 41 are provided with an avoidance hole 411 matched with the button 431. When an external force is applied to the button 431, the button 431 is located in the avoidance hole 411, so that the button 431 completely enters the first case body 2, and slides out of the first case body 2 along the avoidance slot 211 so as to separate the lifting mechanism 4 from the first case body 2. When the button 431 slides along the avoidance slot 211 to the clamping hole 221 during installation, the button 431 automatically pops out from the avoidance hole 411 due to the elasticity of the button 431, returns to the original position, and is again clamped in the clamping hole 221. With reference to FIG. 3, further, a raised strip 414 is provided between the avoidance hole 411 and the bottom plate 42 on the both sides of the lifting platform 41. The raised strip 414 and the button 431 are in contact with each other or form a small gap, so as to ensure that the lifting platform 41 does not shake during the movement and remains stable; and it also ensures that the button 431 on the fixed sleeve 43 is prevented from being easily pressed down and accidentally disengaged from the first case body 2.

Figure 6:
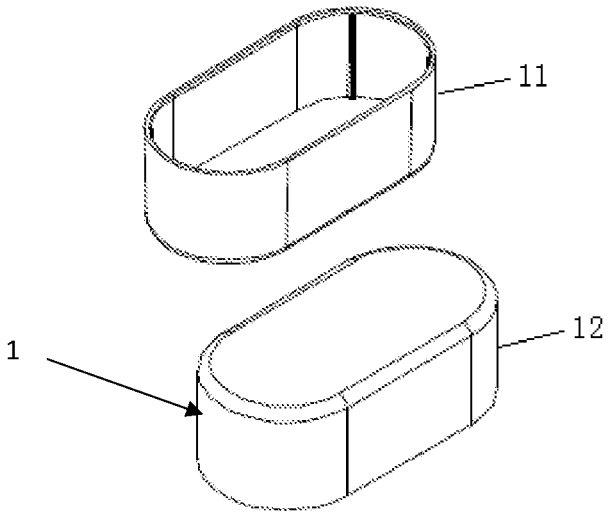
FIG. 6 is a schematic view showing an exploded structure of a first case cap of a packaging device according to an embodiment of the present invention.

Referring to FIGS. 3, 5 and 6, in a preferred embodiment, a side wall 12 of the first case cap 1 is sleeved with a case cap sleeve 11, and an outer side of the base 45 is sleeved with a base sleeve 46. Preferably, the inner case 21, the first case cap 1 and the lifting mechanism 4 are all made of plastic; and the outer case 22, the case cap sleeve 11 and the base sleeve 46 are all made of aluminum alloy. Further, secondary processes such as anodization, spraying, printing, laser engraving, etc. may be performed on the case cap sleeve 11, the outer case 22, and the base sleeve 46 to make the product more textured and aesthetic.

Embodiments of the present invention provide a packaging device. The assembly process includes that, firstly, the bottom plate 42 is inserted into the bottom of the lifting platform 41 for assembling and fixing; then, the rotating table 47 on the base 45 passes through the second through hole on the bottom 432 of the fixed sleeve 43 and is inversely fastened to the bottom 432 to complete the assembly of the base 45 and the fixed sleeve 43, and the base 45 can rotate relative to the fixed sleeve 43 via the rotating table 47; the threaded rod 44 located in the rotating table 47 passes through the first through hole 421 on the bottom plate 42, and the lifting platform 41 is rotated to the end by rotating counterclockwise; at this moment, the fixed sleeve 43 is sleeved around the lifting platform 41 and the lifting platform 41 protrudes from the open end 433 of the fixed sleeve 43 to complete the assembly of the lifting mechanism 4; then, the lifting mechanism 4 is pushed in from the second end 24 of the first case body 2, the buttons 431 on both sides of the fixed sleeve 43 slide along the avoidance slot 211 to the clamping hole 221, and the lifting mechanism 4 is fixed in the first case body 2; and the first case cap 1 is covered on the first end 23 of the first case body 2 to complete assembly.

The specific shape of the packaging device is not particularly limited in the present embodiment, and may be a box shape, a bottle shape, a can shape, etc. depending on the type of pasty or solid household chemicals or the desired design shape, such as a tubular shape for lipsticks, a shape shown in FIG. 1 for deodorant cream, a cylindrical shape for pressed powder, etc. The packaging device can be reused so long as the structure of the packaging device provided in the present invention is used to detachably connect the first case body 2 with the lifting mechanism 4 for ease of replacement, and the lifting mechanism 4 moves with the cosmetic paste in the refill device 3.

Figure 7:
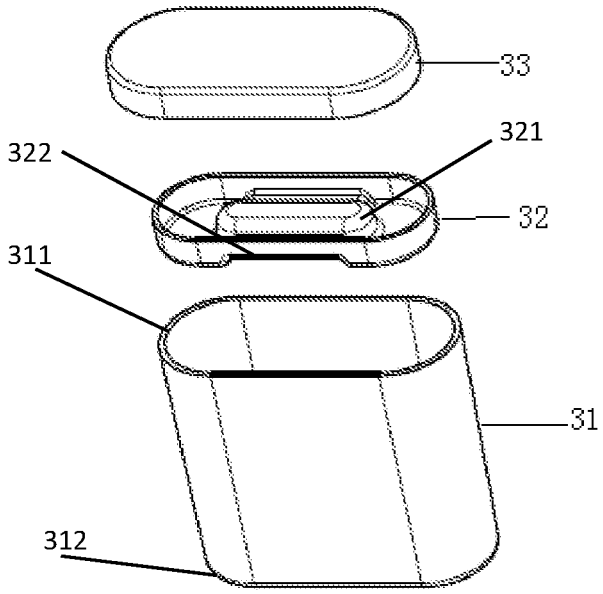
FIG. 7 is a schematic view showing an exploded structure of a refill device according to an embodiment of the present invention.
Figure 8:
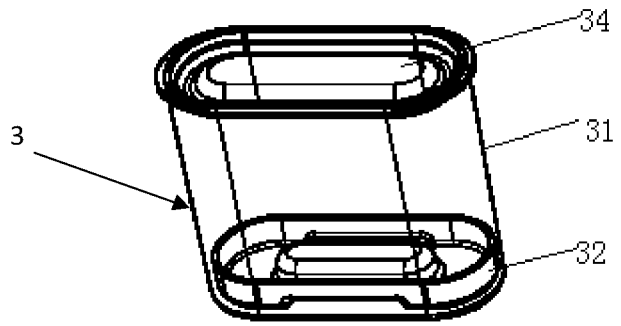
FIG. 8 is a schematic view showing an overall structure of a refill device according to another embodiment of the present invention.
Figure 9:
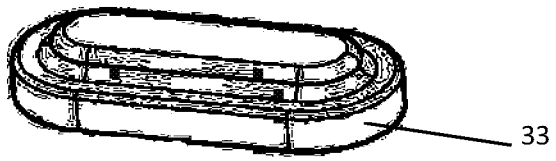
FIG. 9 is a schematic view showing a structure of a second case cap of a refill device according to another embodiment of the present invention.

Referring to FIGS. 7 and 8, the present embodiment also provides a refill device which can be used in combination with the above packaging device. The refill device 3 includes a second case body 31 and a case bottom 32; the second case body 31 has a third end 311 and a fourth end 312; the case bottom 32 is detachably embedded at the fourth end 312 of the second case body 31, and can move along the inner cavity of the second case body 31 in the direction of the third end 311 of the second case body 31; and the second case body 31 and the case bottom 32 constitute a case body for containing the pasty or solid household chemicals. Furthermore, the refill device 3 further includes a second case cap 33, wherein the second case cap 33 is snap-fitted on the second case body 31 and is separable from the second case body 31; the second case cap protects the household chemicals which has not been used in the refill device 3 from being contaminated; and the second case cap 33 can be a case cap which is an outer cover as shown in FIG. 7 or an embedded case cap as shown in FIG. 8. Since the refill device 3 removes the second case cap 33 during use, the second case cap 33 should be separably connected to the second case body 31. The removed second case cap 33 may be discarded or may be snapped onto the first end 23 of the first body 2 and then snapped onto the first case cap 1 to double protect the household chemicals in the refill device 3. Further, as shown in FIG. 9, the top of the outer cover-type second case cap 33 is protruded outwardly to facilitate the opening operation; and the pasty or solid household chemicals are more beautiful by being formed by the reverse filling of the case bottom 32 to the refill device 3. In a specific embodiment, the fourth end 312 of the second case body 31 extends inwardly to form a first flange, so that the opening size of the fourth end 312 of the second case body 31 is smaller than the size of the case bottom 32. Therefore, the first flange embeds the case bottom 32 within the second case body 31. In this embodiment, the second case body 31, the case bottom 32 and the second case cap 33 are all made of degradable materials. Furthermore, the second case body 31, the case bottom 32 and the second case cap 33 are all made by paper materials from a paper pulp die-casting process, and are environmentally friendly, degradable, and can also be recycled.

Figure 10A:
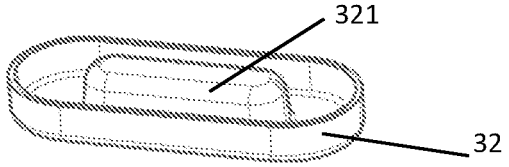
FIG. 10*a* is a schematic view showing the structure of a case bottom of a refill device according to another embodiment of the present invention.
Figure 10B:
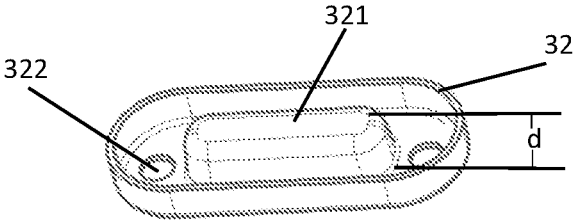
FIG. 10*b* is a schematic view showing the structure of a case bottom of a refill device according to yet another embodiment of the present invention.
Figure 10C:
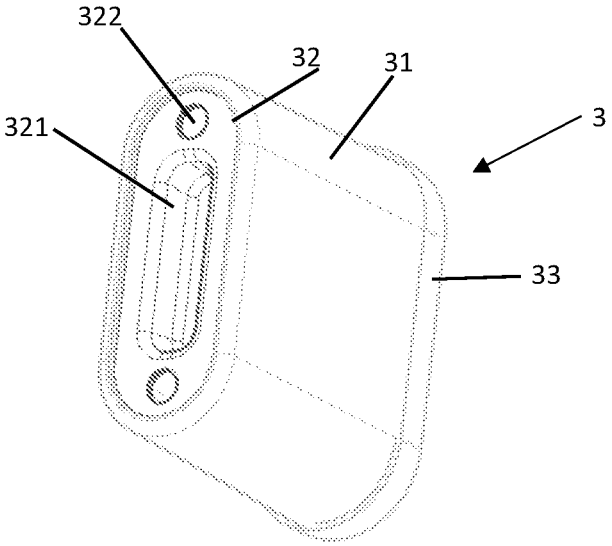
FIG. 10*c* is a schematic view showing the structure of a refill device having the case bottom shown in FIG. 10*b;*

Referring to FIGS. 10*a*, 10*b* and 10*c*, the bottom of the case bottom 32 is recessed toward the third end to form a groove 321 having a shape and a size matched with those of the boss 412 shown in FIG. 4; the depth of the groove 321 is preferably 6-8 mm, more preferably 6.5-7.5 mm; and the depth of the groove 321 refers to a height d of the groove 321 from the bottom to the top, as shown in FIG. 10*b*. The groove with a greater depth d, especially cooperated with a barb 415 of the boss, can increase the friction between the case bottom 32 and the boss 412, which solves the problem that the lifting platform 41 is easy to fall off due to insufficient friction between the case bottom 32 and the lifting platform 41 during the process of pushing the household chemicals to rise, and can make the case bottom 32 and the pasty or solid household chemicals move smoothly. In yet another embodiment, referring to FIGS. 10*b* and 10*c*, the bottom of the case bottom 32 is provided with at least one third through hole 322 through which liquid household chemicals can be filled into the refill device 3. Preferably, the third through holes 322 have the number of two and are symmetrically located at both sides of the groove 321.

Figure 11:
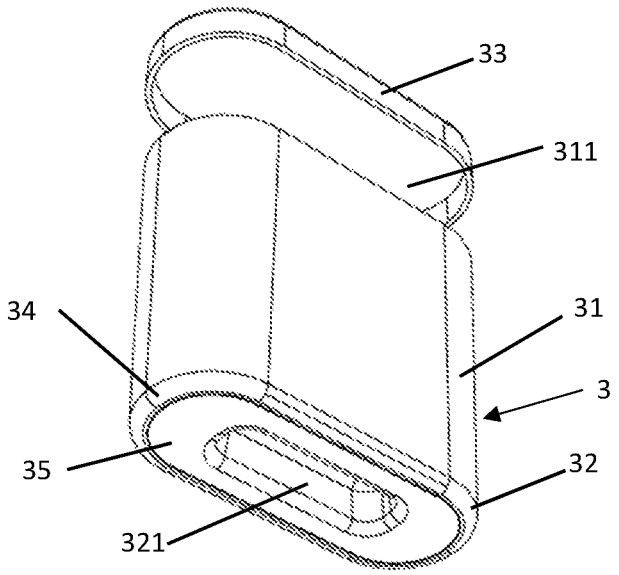
FIG. 11 is a schematic view showing the structure of a refill device according to yet another embodiment of the present invention.

With reference to FIG. 11, in a further embodiment, the case bottom 32 and the second case body 31 are integrally formed; the case bottom 32 is provided with a first cutting line 34 for enclosing a portion to form a bottom bracket 35; the bottom bracket 35 can be separated from the case bottom 32 along the first cutting line 34 by an external force. Further, the first cutting line 34 has the same shape as the outer contour line of the case bottom 32; and the bottom bracket 35 is located at the center of the case bottom 32.

In the present embodiment, the first cutting line 34 is cut from the bottom of the case bottom toward the open end 311; and the depth of the first cutting line 34 is preferably 4/5-9/10 of the thickness of the case bottom 32 at its location. The distance between the first cutting line 34 and the edge of the case bottom is preferably between 2 mm and 5 mm.

Figure 12:
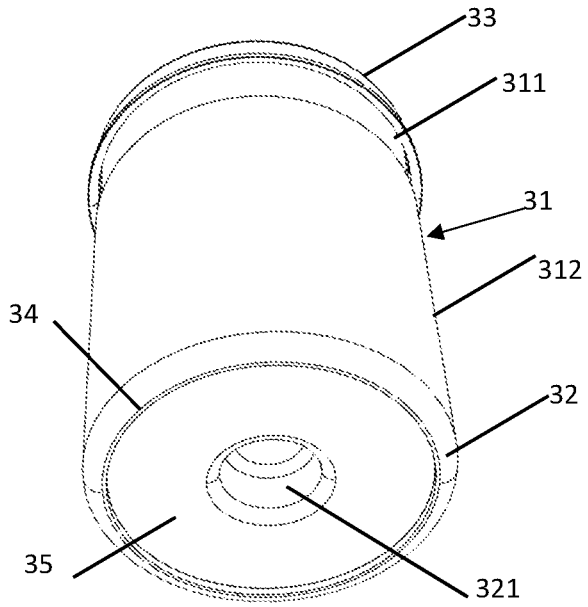
FIG. 12 is a schematic view showing the structure of a refill device according to yet another embodiment of the present invention.

In an embodiment, as shown in FIG. 11, the cross-sectional shape of the case body is rectangular in the middle and semicircular at both ends. In other embodiments, the case body may also be cylindrical, as shown in FIG. 12. The specific shape of the case body may be set as required, and this embodiment is not particularly limited.

Figure 13:
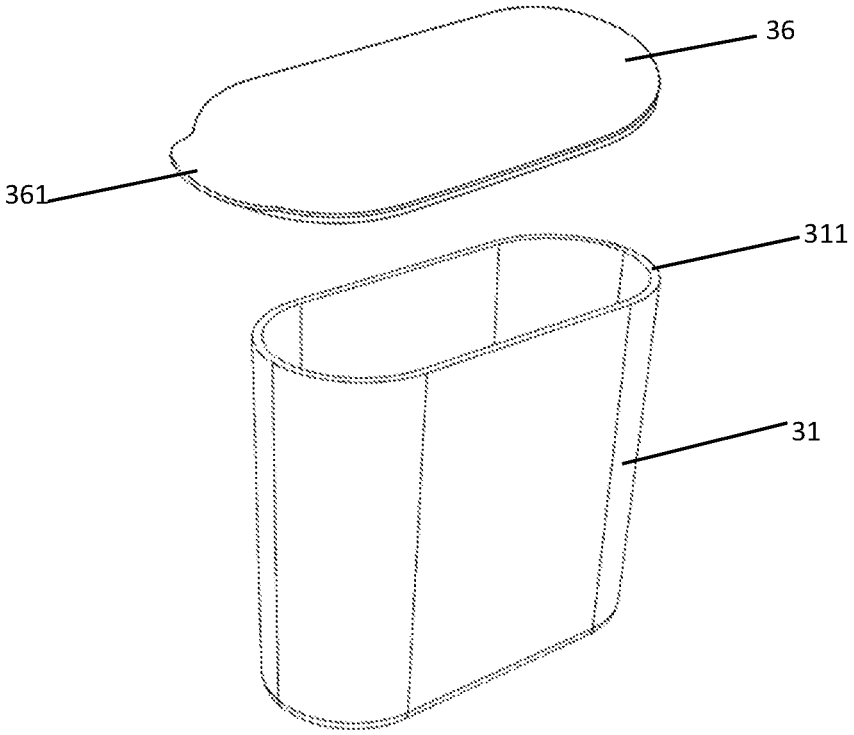
FIG. 13 is a schematic exploded view of a refill device according to yet another embodiment of the present invention.
Figure 14:
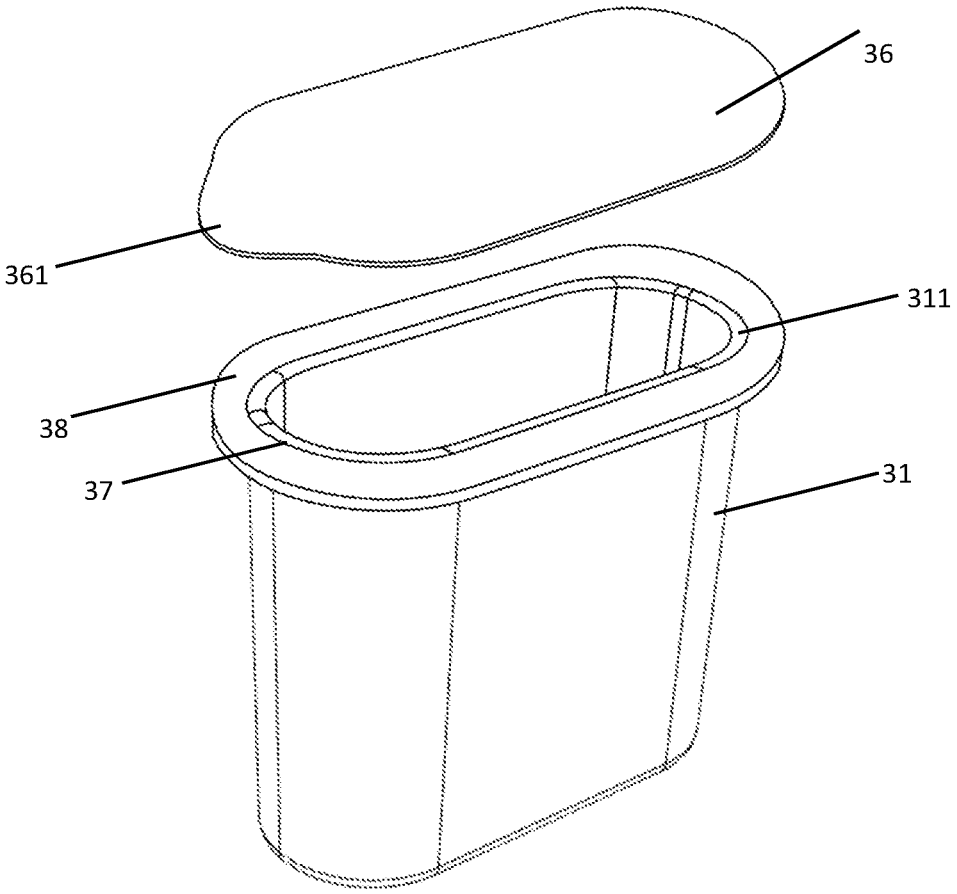
FIG. 14 is a schematic exploded view of a refill device according to yet another embodiment of the present invention.

Referring to FIG. 13, in another embodiment, the open end 311 of the case body is covered with a protective film 36 closing the open end 311, and the protective film 36 can be separated from the case by an external force. When the refill device 3 is used, the protective film 36 is removed to be used in combination with the external packaging device; and the protective film 36 replaces the case cap 33 to protect the household chemicals which have not been used in the refill device 3 from being contaminated, so that the manufacturing process of the case cap is omitted to save materials and improve efficiency. With reference to FIG. 14, in a particular embodiment, a flanging 38 may also be formed at the open end 311 of the case body to extend outside the case body; the flanging 38 is integrally formed with the second case body 31; the outer contour line of the flanging 38 may have the same shape as the open end 311 of the case body; the edge of the protective film 36 is coated on the surface of the flanging 38. Preferably, the width of the flanging 38 is 3-5 mm; and the flanging 38 has a certain width to ensure an area to which the protective film 36 is coated and to ensure firm application. The edge of the protective film 36 extends to the outside of the case body to form a ripped portion 361 to facilitate the removal of the protective film 36 by the application of force. The protective film 36 is preferably an aluminum film and is environmentally friendly.

Figure 15:
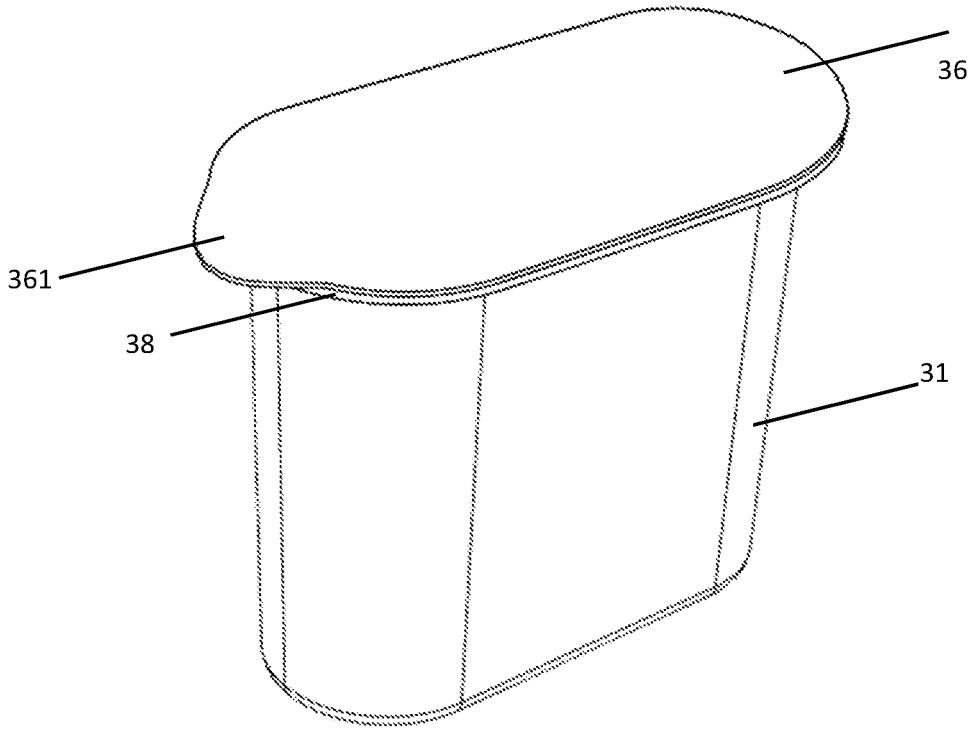
FIG. 15 is a schematic view of the packaging of the refill device of FIG. 14.

Referring to FIGS. 14 and 15 together, an annular second cutting line 37 is provided at the junction of the case body and the flanging 38; and the flanging 38 can be separated from the second case body 31 along the second cutting line 37 by an external force. When the protective film 36 is removed, the flanging 38 may be separated from the case body with the protective film 36 for more convenient use.

Figure 16:
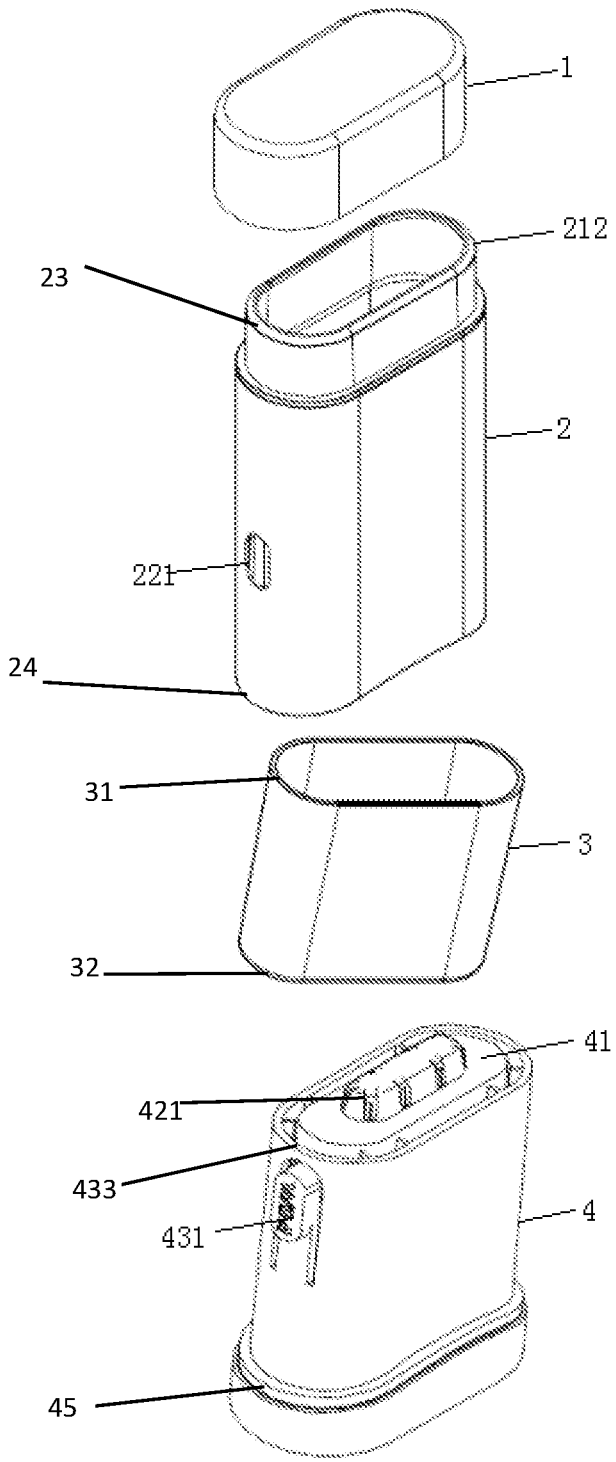
FIG. 16 is a disassembled schematic view of a pasty cosmetic packaging device containing a refill device according to an embodiment of the present invention.

With reference to FIG. 16, the present embodiment also provides a refillable pasty cosmetic, including a packaging device and a refill device 3, wherein the refill device 3 contains cosmetic paste (not shown); a fourth end 312 of a second case body 31 is opened and loaded into a first case body 2; a third end 311 of the second case body 31 is clamped on a first end 23 of the first case body 2; and the fourth end 312 of the second case body 31 abuts against an end surface of an open end 433 of a fixed sleeve 43, so that the second case body 31 is fixed in the first case body 2 without moving. The top surface of the lifting platform 41 of the lifting mechanism 4 abuts against the case bottom 32 of the refill device 3. When the lifting platform 41 is moved along the threaded rod 44 by rotating the base 45, the cosmetic paste is driven to move relative to the second case body 31, so that the cosmetic paste is exposed at the first end 23 of the first case body 2 for a consumer to use, or is retracted into the second case body 31 for storage after use. Further, the first end 23 of the first case body 2 extends inwards to form a second flange 212, and the second flange 212 enables the opening size of the first end 23 to be smaller than that of the third end 311 of the second case body 31, so that the third end 311 of the second case body 31 is clamped in the first case body 2; and when the lifting platform 41 moves, only the cosmetic paste is moved, while the second case body 31 is fixed. Furthermore, the top surface of the lifting platform 41 is convexly provided with a boss 412. Accordingly, the case bottom 32 is provided with a groove 321 matched with the boss 412, so that the boss 412 abuts in the groove 321, preventing the cosmetic paste in the second case body 31 from shaking or tilting, and the cosmetic paste can move smoothly.

The pasty or solid household chemicals described in the present invention include, but are not limited to, deodorant cream, lipsticks, pasty lip gloss, eye shadows or pressed powder. The packaging device and refill device provided in the present invention can be used as long as the pasty or solid household chemicals are used.

According to the present invention, there is provided a refillable paste cosmetic, the process of replacing a refill including:

1. rotating the base 45 counterclockwise to the end;

2. Pressing the buttons 431 at the clamping holes 221 at both sides of the first case body 2, so that the button 431 retracts into the avoidance hole 411 and is completely located in the first case body 2; and at the same time, holding the base 45 and pulling it downwards, the button 431 sliding out of the second end 24 of the first case body 2 along the avoidance slot 211, so that the lifting mechanism 4 is disengaged from the first case body 2;

3. taking out a refill device 3 after the cosmetic paste has been used up;

4. taking a new refill, namely, a product after the cosmetic paste is loaded into the refill device 3, and removing the second case cap 33;

5. assembling the refill in the first case body 2, so that the third end 311 of the second case body 31 is clamped at the second flange 212 of the first end 23 of the first case body 2;

6. then loading the lifting mechanism 4, which has just been separated, into the first case body 2 from the second end 24, and sliding the buttons 431 on the both sides of the fixed sleeve 43 into the clamping hole 221 along the avoidance slot 211, so that the lifting mechanism 2 is fixedly mounted with the first case body 2; at this moment, the fourth end 312 of the second case body 31 abuts against the open end of the fixed sleeve 43, and the boss 412 of the lifting platform 41 abuts against the groove 321 of the case bottom 32, so as to complete the replacement of the refill; and 7. putting the replaced empty refill device 3 into a recyclable box for degradation and recycling.

In summary, the present invention provides a packaging device and a refill device, wherein a lifting mechanism and a first case body are detachably connected in the packaging device, and the packaging device and the refill device are used cooperatively; after the lifting mechanism is disassembled, an old refill device can be discarded, and a new refill filled with household chemicals can be loaded into the first case body, so that the packaging device can be reused; the base of the lifting mechanism is rotated to move the lifting platform against the case bottom of the refill device so as to achieve the ejection and retraction of the household chemicals, facilitating the use of the household chemicals; at the same time, the refill device is a degradable material, which can be recycled and more environmentally friendly. Thus, the present invention provides a packaging device that can be reused, resulting in substantial savings in packaging materials, while avoiding significant environmental contamination due to extensive disposal of the packaging materials.

Although the present invention has been described with reference to the preferred embodiments, it is not intended to limit the present invention. Any person skilled in the art may modify and improve it somewhat without deviating from the spirit and scope of the present invention. Therefore, the scope of protection of the present invention shall be defined in the claims.

The invention claimed is:

1. A refill device, characterized by comprising a first case body and a case bottom, the first case body having a first end and a second end;

the case bottom is detachably arranged at the second end of the first case body, and movable along an inner cavity of the first case body towards the first end of the first case body;

the first case body and the case bottom constitute a case body for containing pasty or solid household chemicals;

the refill device is made of paper material and can be loaded into a packaging device and used in conjunction with the packaging device; and the packaging device is equipped with a lifting mechanism, which controls the case bottom to move back and forth near or away from the first end of the first box body at the inner cavity of the first box body.

2. A packaging device, characterized in that the packaging device is used in conjunction with the refill device according to claim 1, the packaging device further characterized by comprising a second case cap, a second case body and a lifting mechanism; wherein:

the second case body has a third end and a fourth end, and the second case cap is snap-fitted on the third end of the second case body;

the lifting mechanism comprises a base and a lifting platform, wherein:

the base and the lifting platform are movably connected, the base is arranged at the fourth end of the second case body, and the lifting platform is arranged in the second case body;

the lifting platform comprises a bottom plate, a lifting platform main body and a boss;

the bottom end of the lifting platform main body is connected to the bottom plate, the top surface of the lifting platform main body is provided with the boss, and the bottom plate is provided with a second through hole;

a threaded rod is fixedly arranged on the base;

the second through hole is engaged with teeth of the threaded rod;

the threaded rod passes through the second through hole and extends into the lifting platform main body; and the bottom plate can move along the threaded rod when the threaded rod rotates, so that the lifting platform can move close to or away from the base.

3. The packaging device according to claim 1, characterized in that 2-16 barbs are provided on the boss, a plurality of the barbs being symmetrically distributed on the boss.

4. The packaging device according to claim 2, characterized in that the lifting mechanism comprises a fixed sleeve having a bottom and an open end, the fixed sleeve being sleeved outside the lifting platform and the lifting platform protruding from the open end of the fixed sleeve;

the bottom of the fixed sleeve is provided with a third through hole;

the base is provided with a rotating table passing through the third through hole and being inversely fastened to the bottom of the fixed sleeve;

the bottom of the threaded rod is fixed to the rotating table; and the base is rotatable relative to the fixed sleeve by the rotating table.

5. The packaging device according to claim 4, characterized in that the fixed sleeve comprises a fixed sleeve main body and buttons provided on both sides of the fixed sleeve main body;

a clamping hole is provided on the second case body at a position corresponding to the button; and the button is clamped in the clamping hole to detachably connect the second case body and the lifting mechanism.

6. The packaging device according to claim 5, characterized in that the second case body comprises an inner case and an outer case, the outer case being closely adhered to the outside of the inner case;

the clamping holes are provided on both sides of the outer case; and an avoidance slot extending towards the fourth end is provided on the side of the inner case at a position corresponding to the position of the clamping hole.

7. The packaging device according to claim 6, characterized in that a side wall of the second case cap is provided with a cap sleeve, and an outer side of the base is provided with a base sleeve; and the inner case, the case cap or/and the lifting mechanism are all made of plastic, and the outer case, the case cap sleeve or/and the base sleeve are all made of aluminum alloy.

8. The packaging device according to claim 5, characterized in that the button is made of an elastic material, or a slotting is formed between the button and the fixed sleeve main body;

both sides of the lifting platform are provided with avoidance holes matched with the buttons; and when the button is located in the avoidance hole, the lifting mechanism can be detached from inside of the second case body.

9. The packaging device according to claim 8, characterized in that the lifting platform main body is further provided with a raised strip arranged between the avoidance hole and the bottom of the lifting platform.

10. The packaging device according to claim 2, characterized in that the top of the threaded rod is provided with at least one tab that can be clamped to the bottom plate at the second through hole to prevent the bottom plate from being separated from the threaded rod.

11. The packaging device according to claim 10, characterized in that the tabs have the number of 2 and are arranged symmetrically at the top of the threaded rod;

the tabs are integral with the threaded rod; and the threaded rod, the rotating table and the base are integrally formed.

12. The refill device according to claim 1, characterized in that the second end of the first case body is formed with a first flange extending inwards, and the first flange locates the case bottom inside the first case body;

or, the case bottom and the first case body are integrally formed;

the case bottom is provided with a first cutting line for enclosing a portion to form a bottom bracket; and the bottom bracket can be separated from the first case body along the first cutting line under the action of an external force.

13. The refill device according to claim 1, characterized by further comprising a first case cap that snaps onto and is detachable from the first case body;

the first case cap is an embedded case cap or an outer cover-type case cap;

or an open end of the case body is covered with a protective film closing the open end;

the open end of the case body extends to the outside of the case body to form a flanging;

the protective film is coated on the surface of the flanging;

the case body is separated from the flanging by a first cutting line; and the flanging can be separated from the case body along the first cutting line under the action of an external force.

14. The refill device according to claim 13, characterized in that the bottom of a case bottom is recessed in the direction of the first end to form a groove, with the depth of the groove being 6-8 mm;

at least one first through hole is provided on a bottom of the case bottom; and the first through hole is used for pouring liquid household chemicals into the refill device.

* * * * *